US009046871B2

(12) United States Patent
Suzuki et al.

(10) Patent No.: US 9,046,871 B2
(45) Date of Patent: Jun. 2, 2015

(54) PROCESS CARTRIDGE, MAIN CARTRIDGE, SUB CARTRIDGE, AND IMAGE FORMING APPARATUS

(71) Applicant: CANON KABUSHIKI KAISHA, Tokyo (JP)

(72) Inventors: Kensuke Suzuki, Tagata-gun (JP); Jun Miyamoto, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 13/717,148

(22) Filed: Dec. 17, 2012

(65) Prior Publication Data

US 2013/0156464 A1 Jun. 20, 2013

(30) Foreign Application Priority Data

Dec. 19, 2011 (JP) ..... 2011-277689

(51) Int. Cl.
*G03G 21/18* (2006.01)

(52) U.S. Cl.
CPC ..... *G03G 21/1842* (2013.01); *G03G 21/1821* (2013.01); *G03G 21/1846* (2013.01)

(58) Field of Classification Search
CPC ..... G03G 21/1839; G03G 21/1842; G03G 21/1846; G03G 2221/1846; G03G 2221/1853
USPC ..... 399/111, 113
See application file for complete search history.

(56) References Cited

U.S. PATENT DOCUMENTS 8,428,490 B2 * 4/2013 Kawai et al. ..... 399/113

FOREIGN PATENT DOCUMENTS

JP 2005-258024 A 9/2005

* cited by examiner

*Primary Examiner* — David Gray
*Assistant Examiner* — Michael Harrison
(74) *Attorney, Agent, or Firm* — Canon U.S.A., Inc. IP Division

(57) ABSTRACT

A process cartridge includes a main cartridge configured to be attachable to an apparatus body of an image forming apparatus, and a sub cartridge configured to be attachable to the main cartridge, wherein the main cartridge includes a moving member configured to be capable of moving between a first position for preventing, by the moving member contacting the apparatus body, the main cartridge from entering the inside of the apparatus body and a second position for allowing the main cartridge to enter the inside of the apparatus body, and a regulation member capable of moving between a regulation position for locking the moving member at the first position and an allowable position for allowing the moving member to move to the second position, and wherein the regulation member moves to the allowable position by attaching the sub cartridge to the main cartridge.

20 Claims, 14 Drawing Sheets

PROCESS CARTRIDGE, MAIN CARTRIDGE, SUB CARTRIDGE, AND IMAGE FORMING APPARATUS

BACKGROUND OF THE INVENTION

1. Field of the Invention

The present invention relates to a process cartridge, and an image forming apparatus having a process cartridge. The present invention also relates to a main cartridge which a sub cartridge can be attached to and detached from, and a sub cartridge that can be attached to and detached from the main cartridge.

2. Description of the Related Art

An image forming apparatus employing an electrophotographic technology selectively exposes an image bearing member (hereinafter, referred to as photosensitive drum) uniformly charged by a charging device to light using an exposure device to form a latent image on the photosensitive drum. Further, the image forming apparatus develops the latent image with developer (toner) using a development device, transfers the developed image on a recording medium, and presses and heats the transferred image on the recording medium using a fixing device, and thus the image recording is performed.

In such an electrophotographic image forming apparatus, during the use of the apparatus, maintenance such as toner supply and adjustment and replacement of parts is required. To ease the maintenance work, there is a technique, as a replacement unit, a main cartridge and a sub cartridge is provided such that the sub cartridge can be attached to and detached from the main cartridge. The main cartridge is attached to an apparatus body of an image forming apparatus.

For example, Japanese Patent Application Laid-Open No. 2005-258024 provides a technique that has been in practical use in which, as a sub cartridge, a toner bottle (developer cartridge) containing toner is integrated as a unit, and as a main cartridge, a cartridge (development cartridge) having a development device is integrated as a unit, respectively. The developer cartridge can be attached to and detached from the development cartridge, and the development cartridge having the developer cartridge can be attached to and detached from the apparatus body of the image forming apparatus.

In such a technique, there is a possibility that only the development cartridge is attached to the image forming apparatus without attaching the developer cartridge to the development cartridge, and the image forming apparatus is operated. If the image forming apparatus is operated in such a state where only the development cartridge is attached, the toner is not supplied to the development device having the development cartridge, and as a result, the image formation is not properly performed.

To solve the problem, a detection device for detecting whether the developer cartridge is attached to the image forming apparatus body can be provided to notify the user that the developer cartridge is not attached with a lamp or display screen on an operation unit. However, the installation of the device complicates the structure of the apparatus body, and further, the notification can be issued only after the cartridge is attached to the apparatus body.

SUMMARY OF THE INVENTION

The present invention is directed to a process cartridge and an image forming apparatus capable of preventing attachment of a main cartridge to an apparatus body of the image forming apparatus in a state a sub cartridge is not attached to the main cartridge.

According to an aspect of the present invention, A process cartridge used in an image forming apparatus includes a main cartridge having a process device acting on a photosensitive member and configured to be attachable and detachable to and from an apparatus body of the image forming apparatus, and a sub cartridge having a developer containing portion storing developer to be supplied to the main cartridge and configured to be attachable and detachable to and from the main cartridge, wherein the main cartridge includes a moving member configured to be capable of moving between a first position for preventing, by the moving member contacting the apparatus body, the main cartridge from entering the inside of the apparatus body and a second position for allowing the main cartridge to enter the inside of the apparatus body, and a regulation member capable of moving between a regulation position for locking the moving member at the first position and an allowable position for allowing the moving member to move from the first position to the second position, and wherein the regulation member moves from the regulation position to the allowable position by attaching the sub cartridge to the main cartridge.

According to another aspect of the present invention, a main cartridge attachable and detachable to and from an apparatus body of an image forming apparatus includes a process device configured to act on a photosensitive member, an attachment and detachment portion capable of attaching and detaching a sub cartridge containing developer, a moving member configured to be capable of moving between a first position for preventing, by the moving member contacting the apparatus body, the main cartridge from entering the inside of the apparatus body and a second position for allowing the main cartridge to enter the inside of the apparatus body; and a regulation member capable of moving between a regulation position for locking the moving member at the first position and an allowable position for allowing the moving member to move from the first position to the second position, and wherein the regulation member moves from the regulation position to the allowable position by attaching the sub cartridge to the attachment and detachment portion.

According to yet another aspect of the present invention, a sub cartridge attachable and detachable to and from a main cartridge attachable and detachable to and from an apparatus body of an image forming apparatus includes a developer containing portion configured to store developer to be supplied to the main cartridge, and a pressing portion capable of contacting a regulation member provided to the main cartridge, wherein the main cartridge includes a moving member configured to be capable of moving between a first position for preventing, by the moving member contacting the apparatus body, the main cartridge from entering the inside of the apparatus body and a second position for allowing the main cartridge to enter the inside of the apparatus body, and the regulation member is capable of moving between a regulation position for locking the moving member at the first position and an allowable position for allowing the moving member to move from the first position to the second position, and wherein the pressing portion presses the regulation member in the process of attaching the sub cartridge to the main cartridge and thereby the regulation member is moved from the regulation position to the allowable position.

According to yet another aspect of the present invention, an image forming apparatus configured to form an image on a recording medium includes a main cartridge having a process device configured to act on a photosensitive member, a sub cartridge attachable and detachable to and from the main cartridge, and having a developer containing portion storing developer to be supplied to the main cartridge, and an apparatus body which the main cartridge can be attached to and detached from in a state where the sub cartridge is attached to the main cartridge, wherein the apparatus body includes a stopping portion configured to prevent the main cartridge from being attached to the apparatus body in a state where the sub cartridge is removed, and wherein the main cartridge includes a moving member configured to be capable of moving between a first position for preventing, by the moving member contacting the apparatus body, the main cartridge from entering the inside of the apparatus body and a second position for allowing the main cartridge to enter the inside of the apparatus body; and a regulation member capable of moving between a regulation position for locking the moving member at the first position and an allowable position for allowing the moving member to move from the first position to the second position, and wherein the sub cartridge is attached to the main cartridge and thereby the regulation member moves from the regulation position to the allowable position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
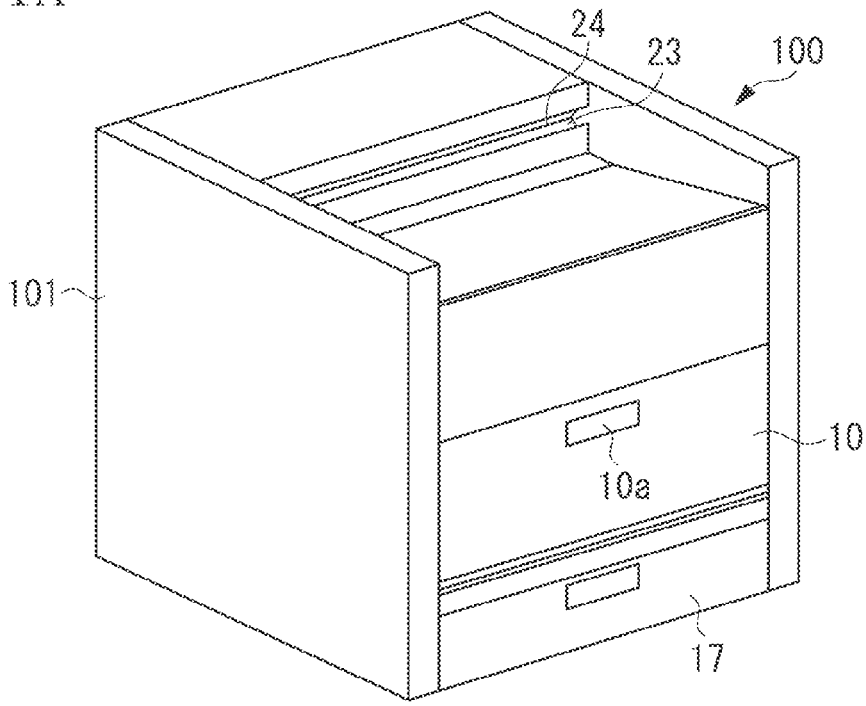
FIG. 1A is an external perspective view illustrating an image forming apparatus.
Figure 1B:
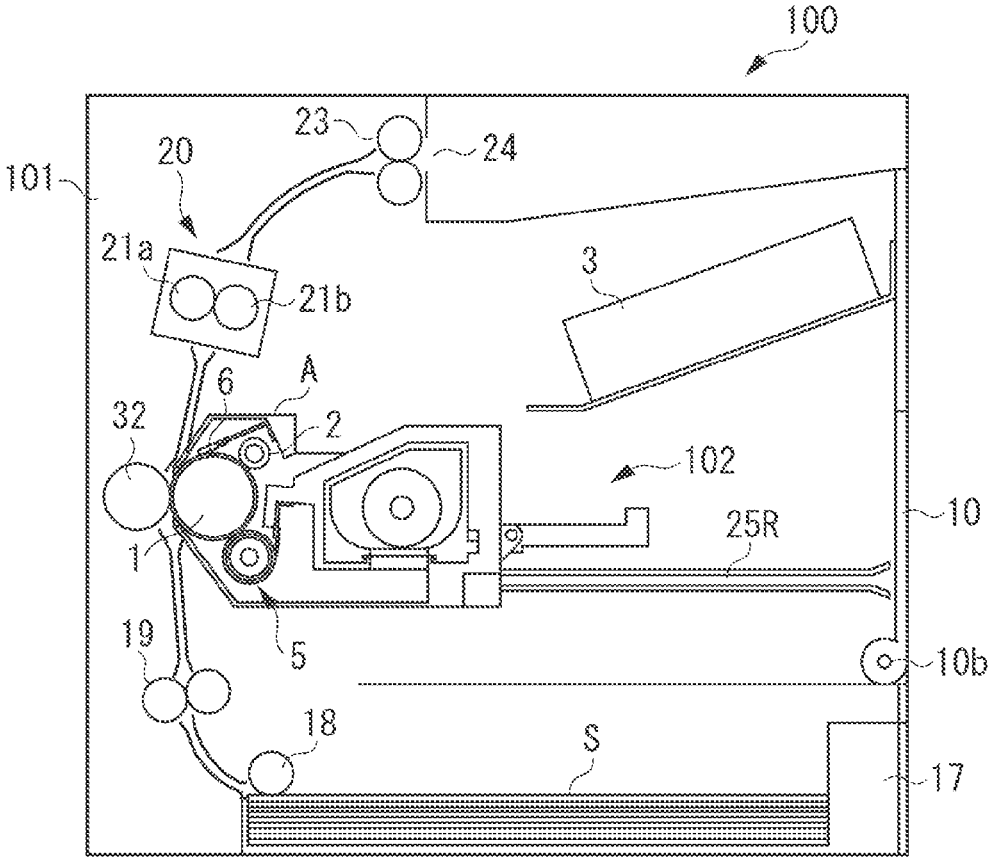
FIG. 1B is a cross-sectional schematic view illustrating the image forming apparatus.
Figure 2A:
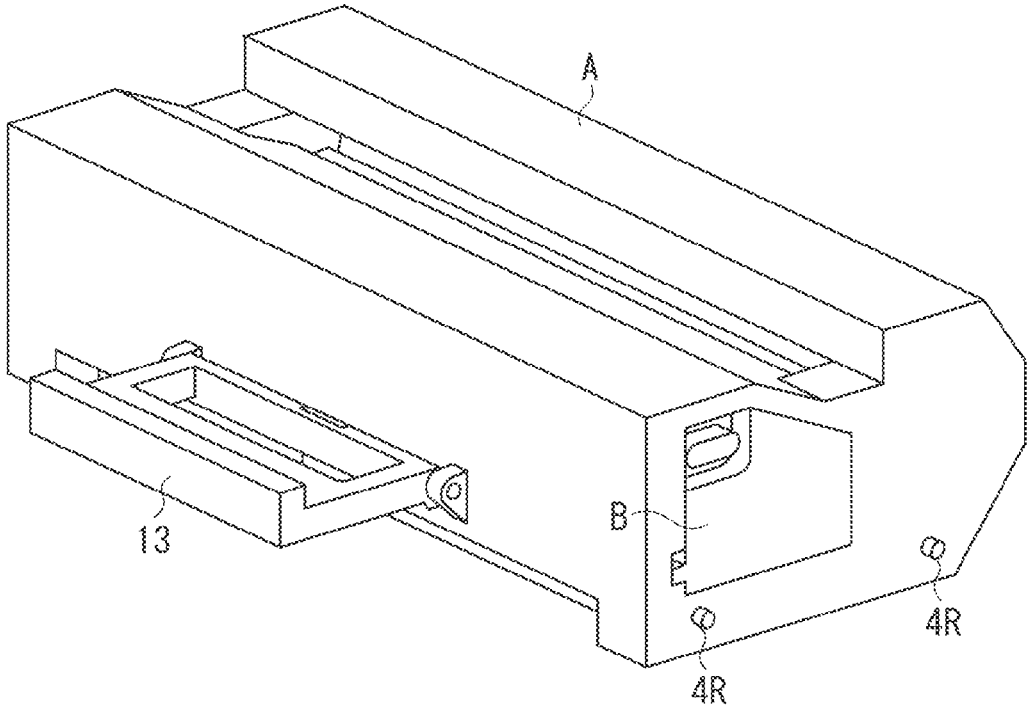
FIG. 2A is an external perspective view illustrating a cartridge A to which a cartridge B is attached.
Figure 2B:
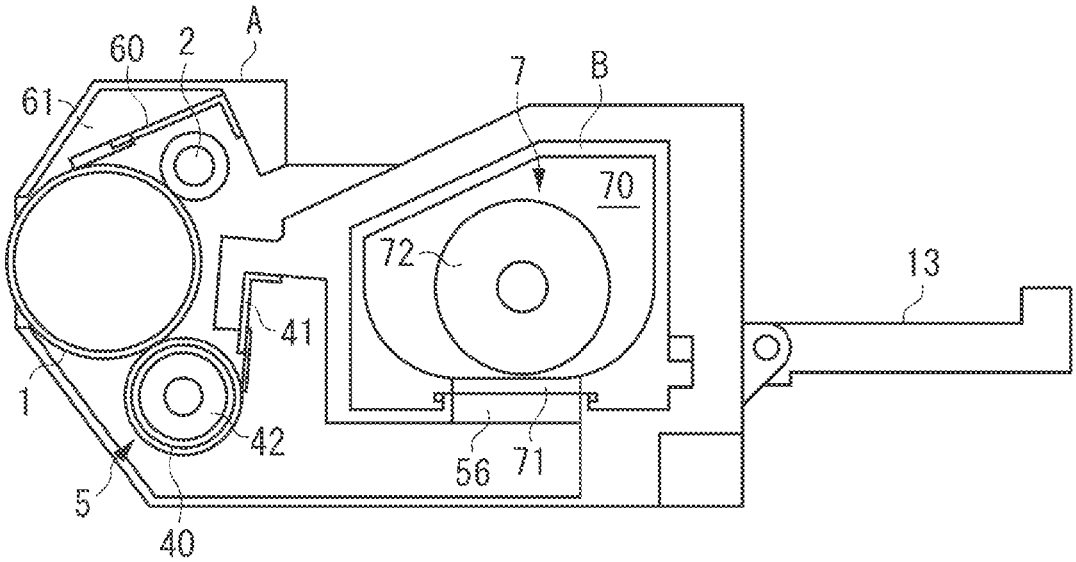
FIG. 2B is a cross-sectional schematic view illustrating the cartridge A.

Hereinafter, an exemplary embodiment of the present invention is described with reference to attached drawings. FIGS. 1A and 1B are an external perspective view and a cross-sectional schematic view illustrating an image forming apparatus 100 according to an exemplary embodiment of the present invention. FIGS. 2A and 2B are an external perspective and a cross-sectional schematic view illustrating a development cartridge A to which a developer cartridge B is attached.

In the description below, with respect to the image forming apparatus, the front side is the side where a door 10 for opening or closing the apparatus is provided. The back side is the opposite side of the front side. The front-back direction is the direction (forward direction) from the back side to the front side of the image forming apparatus and the opposite direction (backward direction).

The right and left is the right side or the left side of the image forming apparatus viewed from the front side. The horizontal direction is the direction (left direction) from the right to the left and the opposite direction (right direction). The apparatus body is an image forming apparatus portion not including the cartridge. In the descriptions about the cartridge, the front-back direction and the horizontal direction of the cartridge in a state where the cartridge is attached to the image forming apparatus are described.

<Whole Structure of Image Forming Apparatus>

The image forming apparatus (electrophotographic image forming apparatus) 100 according to the present exemplary embodiment is a laser beam printer employing an electrophotographic process. In other words, the image forming apparatus 100 performs image formation onto a sheet-like recording medium S according to an electrical image signal input from a host device (not illustrated) such as a personal computer, an image reader, and facsimile device of a receiving side, to a control circuit part (not illustrated).

In the electrophotographic process, a toner image is formed on a drum-shaped electrophotographic photosensitive member 1 (hereinafter, referred to as photosensitive drum 1) with toner (developer). More specifically, the photosensitive drum 1 is charged by a charging unit 2 so that a uniform potential is produced on the drum surface.

Then, the photosensitive drum 1 is irradiated with a laser beam corresponding to the image information by an image exposure unit 3, and thereby a latent image corresponding to the image information is formed on the photosensitive drum 1. The latent image is developed with toner that is a developer by a development unit 5 and a toner image is formed.

Meanwhile, in synchronization with the toner image formation, the recording medium S set in a sheet cassette 17 is conveyed by a sheet feeding roller 18 and a conveyance roller pair 19 to a transfer position. At the transfer position, a transfer roller 32 that serves as a transfer unit is disposed, and the transfer roller applies voltage onto the photosensitive drum 1 to transfer the toner image on the photosensitive drum 1 to the recording medium S.

The recording medium S on which the toner image is transferred is separated from the surface of the photosensitive drum 1, and introduced to a fixing unit 20. The fixing unit 20 includes a heating roller 21*b* that rotates, and a pressure roller 21*a* that presses and contacts the heating roller 21*b* and applies heat and pressure onto the recording medium S. The fixing unit 20 applies the heat and pressure onto the passing recording medium S with the fixing roller pair 21*b* and 21*a* to fix the transferred toner image onto the recording medium S. The recording medium S on which the toner image is fixed by the fixing unit comes out from the fixing unit 20, and discharged by a discharge roller pair 23 to the outside of the apparatus body from a discharge portion 24.

<Development Cartridge A>

The development cartridge A (main cartridge) includes the photosensitive drum 1 and at least one process device that acts on the photosensitive drum 1. The process device can be, for example, a charging unit (charging device) for charging the photosensitive drum 1, a development unit (development device) for developing a latent image formed on the photosensitive drum, and a cleaning unit (cleaning device) for cleaning the outer periphery of the photosensitive drum.

The development cartridge A (hereinafter, referred to as cartridge A) in the present exemplary embodiment includes the photosensitive drum 1, the charging unit (charging device) 2, the development unit (development device) 5, and a cleaning unit (cleaning device) 6.

The photosensitive drum 1 is made by applying an organic photo conducting layer (OPC photosensitive member) on an outer periphery of an aluminum cylinder. The photosensitive drum 1 is rotatably supported by right and left supporting members (not illustrated) of the apparatus body side at the both ends with respect to the drum axis direction as the horizontal direction. At one side of the drum end portions, a driving force transmission unit (not illustrated) for receiving a driving force from a drive motor (not illustrated) is disposed. The driving force is transmitted to the driving force transmission unit, and thereby the drum 1 is driven and rotated in the clockwise direction at a predetermined speed.

In the present exemplary embodiment, the charging unit 2 employs a contact charging method, and the contact charging member is a charging roller (conductive roller) formed in a roller shape. The charging roller 2 is disposed substantially parallel to the drum 1 and to be in contact with the drum 1. The charging roller 2 rotates in conjunction with the rotation of the photosensitive drum 1. To the charging roller 2, a predetermined charging bias voltage is applied from a power source unit (not illustrated) to uniformly produce a predetermined polarity and potential to the surface of the drum 1.

The development unit 5 is a device for visualizing (developing) an electrostatic latent image formed on the drum 1 with toner that is a developer. The development unit 5 includes a development sleeve 40 that supplies the toner to the drum 1, a development blade 41 that regulates the thickness of the toner layer on the outer periphery of the development sleeve 40 and applies an electric charge to the toner, and a magnet roller 42 that is provided in the development sleeve 40.

The cleaning unit 6 removes the residual transfer toner remaining on the surface of the drum 1 after the transfer of the toner image from the photosensitive drum 1. In the present exemplary embodiment, as a cleaning member, a cleaning blade 60 is used. The toner removed from the drum surface is stored in a collected toner containing portion 61.

<Developer Cartridge B>

The developer cartridge B (sub cartridge) includes a toner supplying unit having a toner containing portion (developer containing portion) 70 that contains the toner to be supplied to the main cartridge. In addition to the toner supplying unit, a development unit for developing a latent image formed on the photosensitive drum, a toner collection unit for storing the residual transfer toner removed from the photosensitive drum surface after a toner image transfer, and the like can be provided. The developer cartridge B can be attached to and detached from the cartridge A.

The developer cartridge B (hereinafter, referred to as cartridge B) according to the present exemplary embodiment includes a toner supplying unit 7.

The toner supplying unit 7 supplies the toner to the development unit in the cartridge A. The toner supplying unit 7 includes the toner containing portion 70, a toner supply port 71, a toner conveyance member 72, and a toner supply shutter 73 (refer to FIGS. 2B and 6B).

The toner containing portion 70 stores the toner. The toner supply port 71 communicates with the cartridge A and passes the toner. The toner conveyance member 72 conveys the toner in the toner containing portion 70 to the toner supply port 71. The toner supply shutter 73 opens the toner supply port 71 when the developer cartridge B is attached to the cartridge A. The cartridge A and the cartridge B constitute a process cartridge.

<Cartridge Replacement Method>

The use of the cartridge A and the cartridge B in image formation consumes the toner contained in the cartridge B, and causes deterioration in the process devices such as the photosensitive member of the surface of the photosensitive drum 1 of the cartridge A, and thereby the image quality is deteriorated.

To cope with the problem, for example, a unit (not illustrated) for detecting the remaining amount of toner in the cartridge B can be provided, and in a control circuit part, the detected remaining amount value is compared to a threshold for a preset lifetime notification or lifetime warning of the cartridge B. If the detected remaining amount value is less than the threshold of the cartridge B, on a display portion (not illustrated) of the apparatus body 101, the lifetime notification or the lifetime warning for the cartridge B is displayed.

Alternatively, a unit (not illustrated) for recording the print amount is provided, and in the control circuit portion, the value of the print amount is compared to a threshold for a preset lifetime notification or lifetime warning of the cartridge A. If the value of the print amount exceeds the threshold, on the display portion (not illustrated) of the apparatus body 101, the lifetime notification or the lifetime warning for the cartridge A is displayed The display enables the user to prepare for a replacement cartridge or urges the user to replace the cartridge to maintain the quality of the output image.

<Attachment and Detachment of Cartridge A>

The image forming apparatus in the present exemplary embodiment employs, to increase the usability, a method of attaching and detaching the cartridge A by front access for replacement.

At the front side of the apparatus body 101, a door 10 is provided as a opening and closing member that can move between a close position for closing a cartridge attachment and detachment portion 102 and an open position for opening the cartridge attachment and detachment portion 102. In the present exemplary embodiment, the door 10 can be turned for opening and closing the door around a horizontal shaft (hinge shaft) 10*b* at the lower side of the door with respect to the apparatus body 101.

The user can hold a handle 10*a* provided to the door 10 and turns the door 10 around the hinge shaft 10*b* to close the cartridge attachment and detachment portion 102. The user can also turn the door 10 around the hinge shaft 10*b* to the front side of the apparatus body 101 to open the cartridge attachment and detachment portion 102 (see FIGS. 3A and 3B).

Figure 3A:
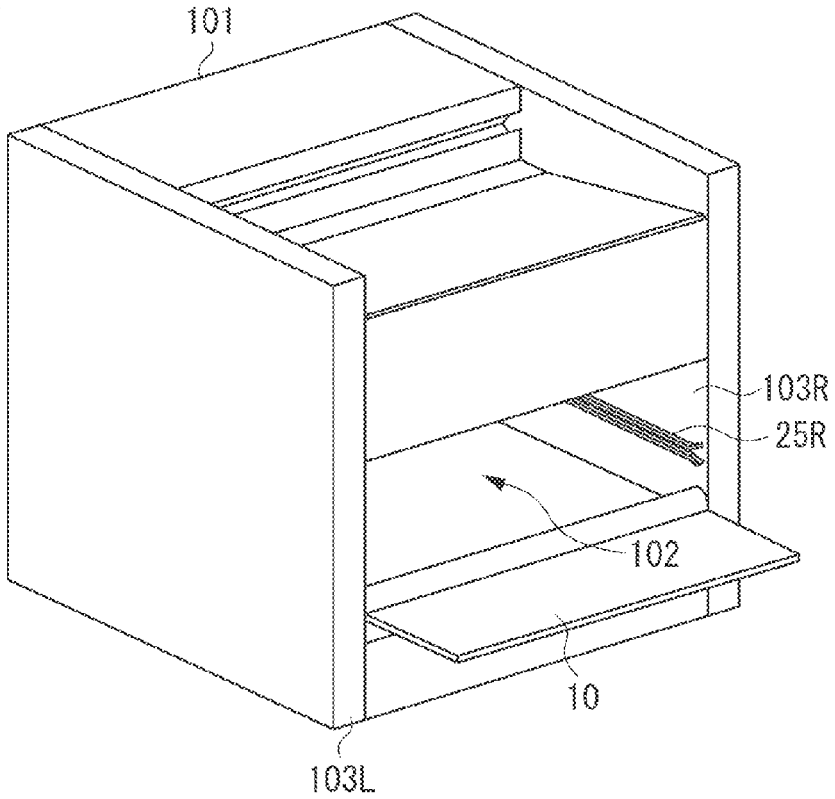
FIGS. 3A and 3B are perspective views illustrating an image forming apparatus in a state the door is open.
Figure 3B:
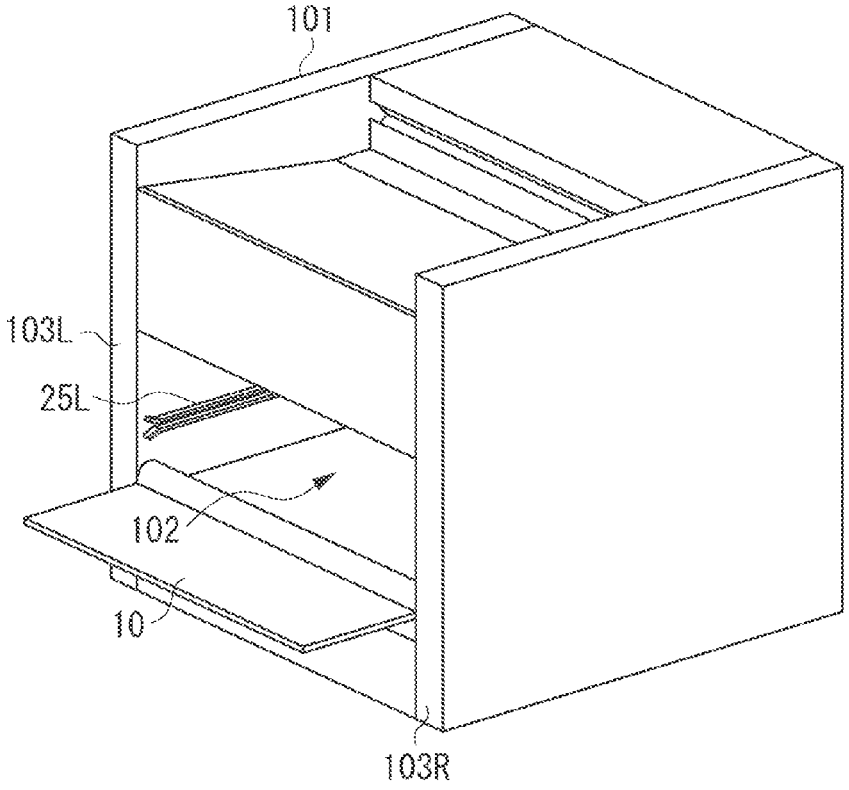

FIGS. 3A and 3B are perspective views illustrating the apparatus body 101 in a state where the door 10 is open and the cartridge A is not attached to the cartridge attachment and detachment portion 102. In the cartridge attachment and detachment portion 102, on the inner wall surfaces of a right side frame 103R and a left side frame 103L of the apparatus body 101, guide portions 25 R and 25L for guiding attachment and detachment of the cartridge A are provided respectively to face each other in a substantially horizontal direction.

On the left side surface portion and the right side surface portion of the cartridge A, guided portions 4L and 4R are provided respectively. The cartridge A engages with the cartridge attachment and detachment portion 102 in a state where the guided portions 4L and 4R of left and right are fit to the corresponding guide portions 25R and 25L of left and right. In the engaged state, the user slides the cartridge A to attach or detach the cartridge A to or from the cartridge attachment and detachment portion 102.

When the user uses a new apparatus body or replaces the used cartridge B, the user performs the attachment and detachment operation of the cartridge A to the apparatus body 101.

The cartridge A includes a grip portion 13. The user holds the grip portion 13 with a hand to easily perform the attachment and detachment operation to the cartridge attachment and detachment portion 102 of the apparatus body 101.

In attaching the cartridge A, the user holds the grip portion 13 extending forward from the outer surface of the cartridge A with a hand and fits the portions 4R and 4L to be guided at the right and left sides to the guide portions 25R and 25L at the right and left sides of the cartridge attachment and detachment portion 102 to engage with each other. The user slides the portions 4R and 4L to be guided along the guide portions 25R and 25L to insert the cartridge A into the cartridge attachment and detachment portion 102. The cartridge A is attached from the front of the apparatus body 101 in a substantially horizontal direction. Then, the user closes the door 10. By the operation, the image forming apparatus 100 is ready for the image forming operation.

The removal operation is performed following the above-described attachment steps in reverse. That is, the user holds the grip portion 13 of the cartridge A with a hand, slides the portions 4R and 4L to be guided along the guide portions 25R and 25L, and removes the cartridge A from the cartridge attachment and detachment portion 102 to the outside.

<Grip Portion of the Cartridge A>

Figure 4:
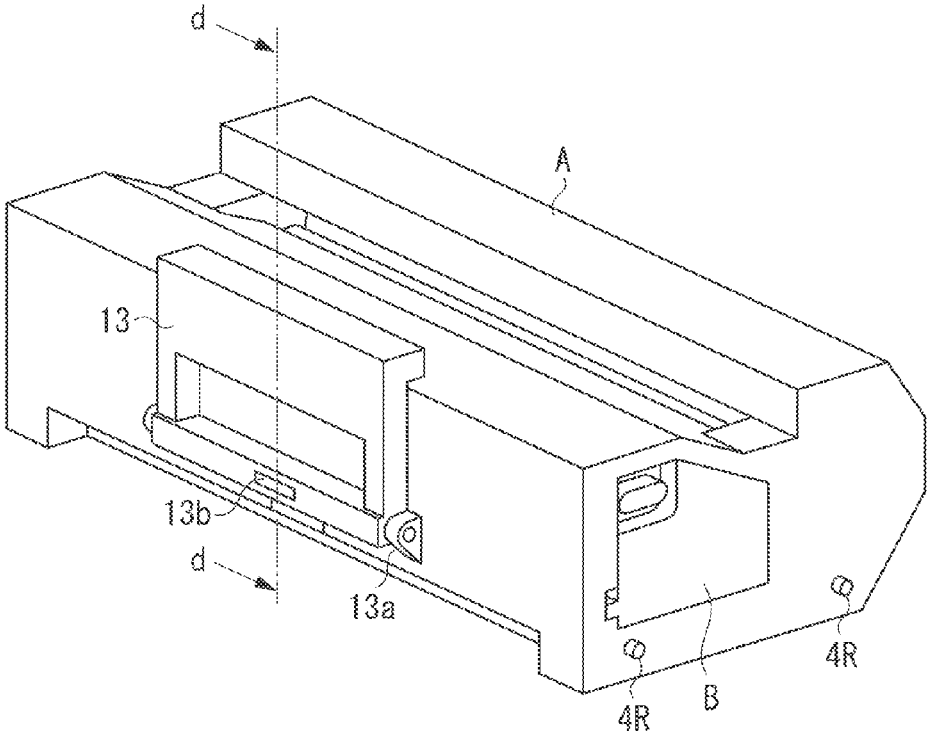
FIG. 4 is a perspective view illustrating the cartridge A having the attached cartridge B and a grip portion set at a first position.

The grip portion (moving member) 13 provided to the cartridge A can be rotated. FIG. 4 is a perspective view illustrating the cartridge A removed from the apparatus body 101 in which the grip portion 13 is rotated viewed from the right direction. In FIG. 4, the position in which the grip portion 13 is raised is referred to as a first position. In FIG. 2A, the position in which the grip portion 13 is turned down is referred to as a second position.

The grip portion 13 is attached to the cartridge A with a rotation center 13*a* being supported, and the grip portion 13 can be rotated around the rotation center 13*a* between the first position and the second position. In other words, as compared to the position of the grip portion 13 at the first position, in a state where the grip portion 13 is set at the second position, the tip of the grip portion at the free end side is far from the outer surface of the cartridge A.

In the attachment of the cartridge A into the apparatus body 101, the grip portion 13 is at the second position where the grip portion 13 extends to the upstream side in the attachment direction to the apparatus body of the cartridge A. As illustrated in FIG. 1B, in the image forming apparatus according to the present exemplary embodiment, the cartridge A is attached and the image formation operation is carried out at the back of the apparatus body 101. Consequently, when the user attaches the cartridge A to the apparatus body 101, the cartridge A is to be pushed all the way inside the cartridge attachment and detachment portion 102 from the front of the apparatus body 101 where the door 10 is provided.

In removing the cartridge A from the apparatus body, the cartridge A attached to the back of the cartridge attachment and detachment portion 102 is to be pulled toward the user. The grip portion 13 provided at the upstream side in the attachment direction of the cartridge A enables the user to hold the grip portion 13 to easily attach the cartridge A to the apparatus body 101.

When the user carries or stores the cartridge A, the user raises the grip portion 13 along the outer wall of the frame of the cartridge A to set the grip portion 13 to the first position. To pack and carry a cartridge A for replacement of the consumable cartridge A, or to store the cartridge A, for users, it is preferable that the cartridge A is small. Unfortunately, if the grip portion 13 is provided on the outer surface of the cartridge A, a large space for packing or storing the cartridge A is needed.

To solve the problem, the grip portion 13 is rotatably designed, and in carrying or storing the cartridge A, the user sets the grip portion to the first position along (near) the outer wall of the frame of the cartridge A. In this way, the cartridge A having the high attachment and detachment operability can be provided while reducing the size.

<Attachment and Detachment of the Cartridge B>

When the user replaces the cartridge B, the user pulls the cartridge A out of the apparatus body 101, and removes the cartridge B from the cartridge A. In the present exemplary embodiment, the cartridge B employs a method of replacing the cartridge from the right side surface of the cartridge A.

Figure 5A:
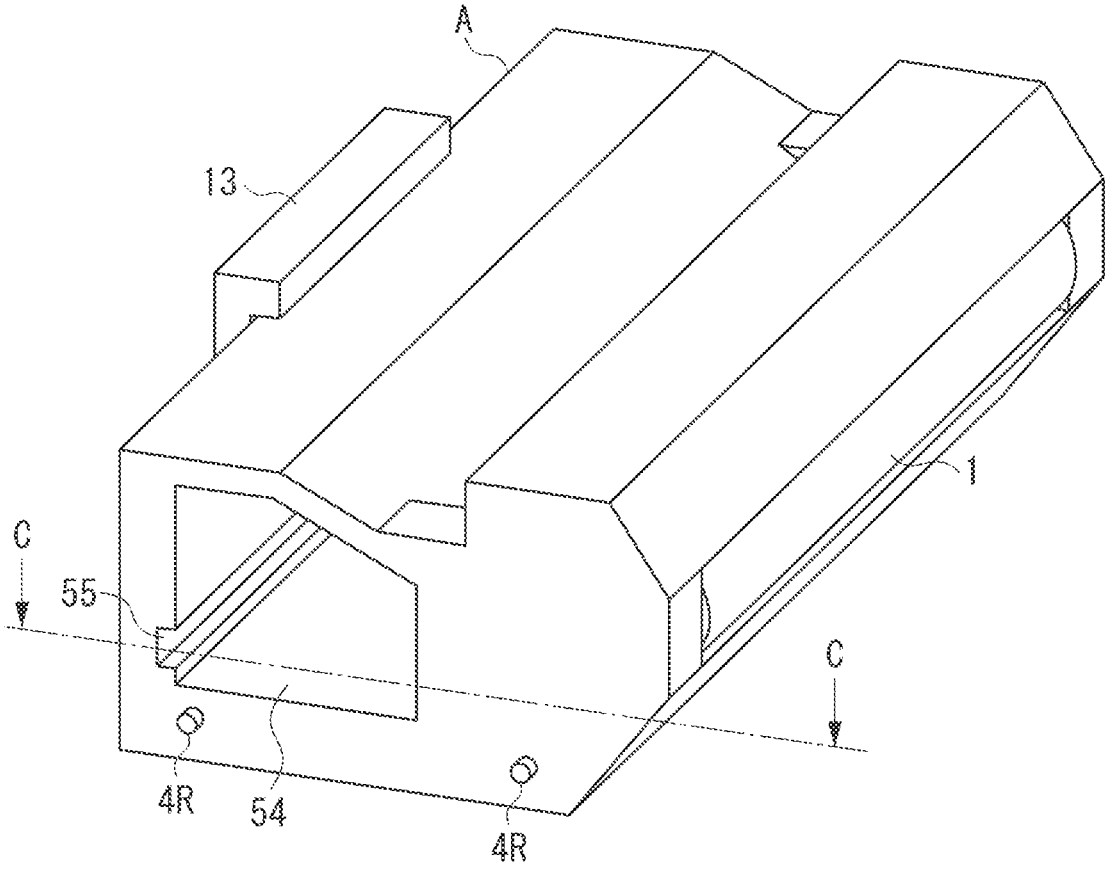
FIG. 5A is a perspective view illustrating the cartridge A from which the cartridge B is removed.
Figure 5B:
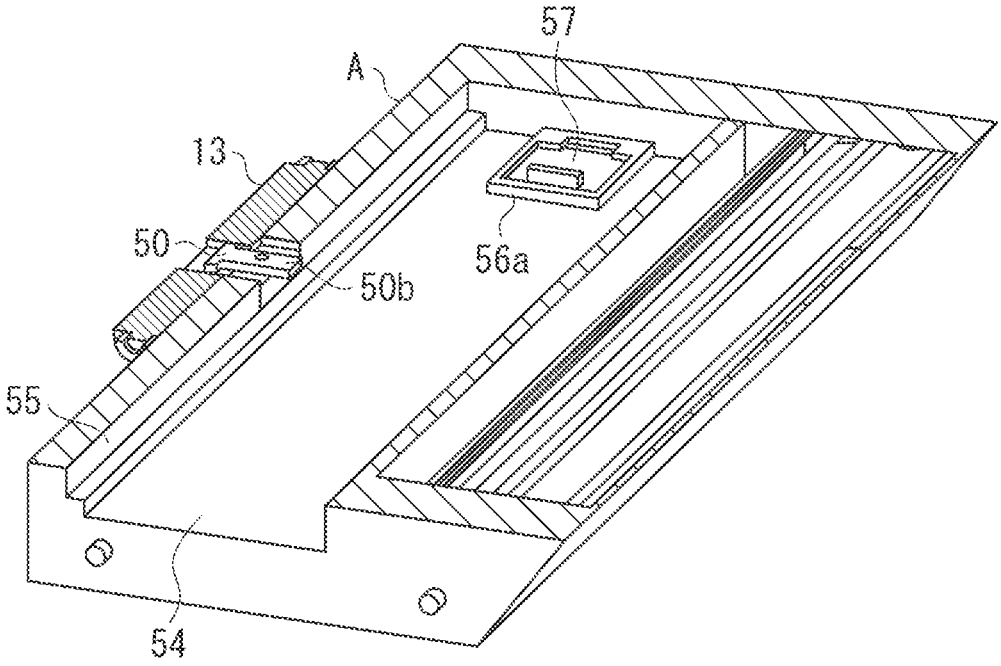
FIG. 5B is a perspective view illustrating the cartridge A taken along the line C-C viewed in the same direction as FIG. 5A.

FIG. 5A is a perspective view illustrating only the cartridge A to which the cartridge B is not attached. FIG. 5B is a cross-sectional perspective view taken along the line c-c viewed from the same direction as FIG. 5A. The cartridge B is attached to a developer cartridge attachment and detachment portion 54 opening at the right side of the cartridge A. On the inner wall surface of the front side of the developer cartridge attachment and detachment portion 54, a guide portion 55 for guiding the attachment and detachment of the cartridge B is provided in the horizontal direction.

Figure 6A:
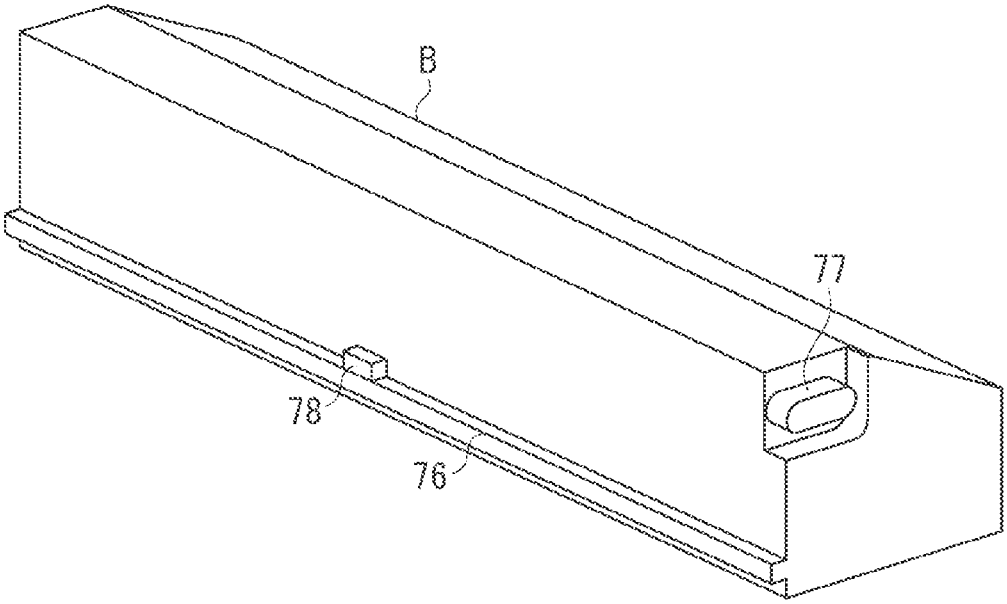
FIG. 6A is a perspective view illustrating the cartridge B viewed from the right direction.
Figure 6B:
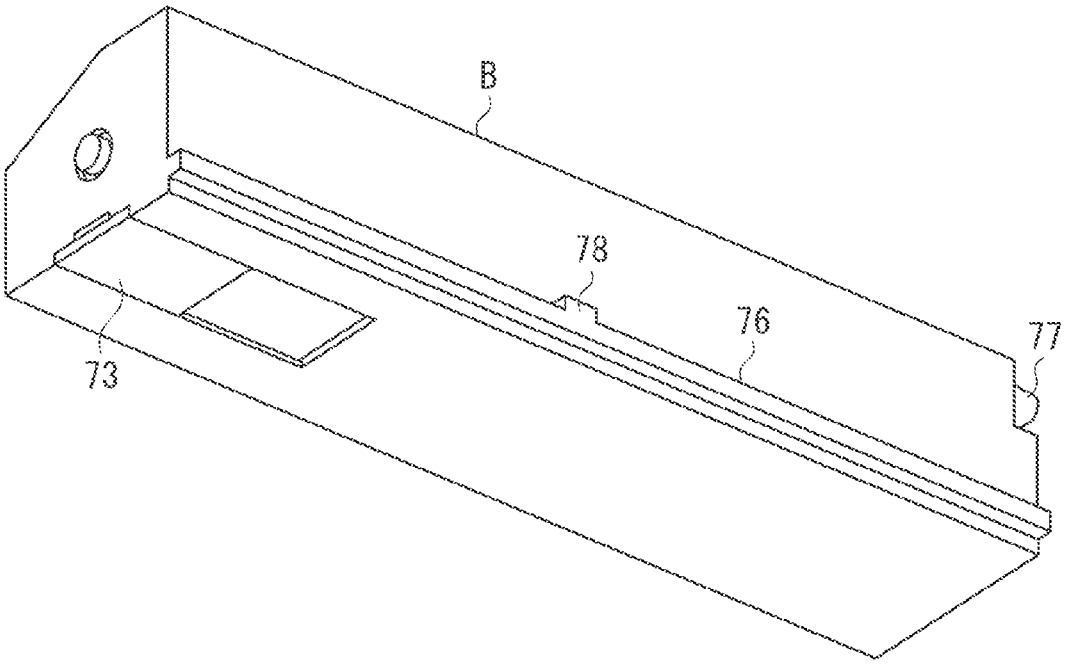
FIG. 6B is a perspective view illustrating the cartridge B viewed from a different direction.

FIG. 6A is a perspective view illustrating the cartridge B viewed from the right direction. FIG. 6B is a perspective view illustrating the cartridge B viewed from a different direction. The cartridge B includes a guided portion 76 of a rib shape horizontally provided along the attachment direction of the cartridge B. The user slides the guided portion 76 to fit to the guide portion 55 of the cartridge A to attach or detach the cartridge B to or from the developer cartridge attachment and detachment portion 54. The user can attach or detach the cartridge B by holding a handle 77 with fingers, the handle 77 is provided on the right side surface of the cartridge B.

The user replaces the used cartridge B in the following steps. First, the user holds the grip portion 13 of the cartridge A pulled out from the apparatus body 101 and moves it to the first position. In the present exemplary embodiment, the cartridge B can be pulled out only when the grip portion is set at the first position with a mechanism described below.

Then, the user holds the holder 77 of the cartridge B, and slides the cartridge B in the right direction along the guide portion 55 to remove the cartridge B from the cartridge A. For the replacement of the used cartridge B, the user holds a new cartridge B for replacement prepared in advance, and slides the guided portion 76 to fit to the guide portion 55 to attach the cartridge B to the developer cartridge attachment and detachment portion 54. After the new cartridge B is attached, the user moves the grip portion 13 to the second position, and thereby the cartridge A can be attached to the apparatus body 101.

After the cartridge B is attached to the cartridge A, a toner intake port 56 of the cartridge A communicates with a toner supply port 71 of the cartridge B, and the toner is supplied from the cartridge B to the cartridge A. As the attachment of the cartridge B proceeds, a toner intake shutter 57 is pressed by the cartridge B, and the toner intake port 56 opens.

Substantially simultaneously with the operation, a toner supply shutter 73 is pressed by an edge portion 56*a* of the toner intake portion 56, and the toner supply port 71 opens. To remove the cartridge B, the user performs operation following the above-described steps in reverse, and thereby the toner intake port 56 and the toner supply port 71 are closed.

<Stopper>

In the present exemplary embodiment, to prevent the attachment of only the cartridge A to the apparatus body without the cartridge B being attached, a stopper (regulation member) 50 provided to the cartridge A regulates the operation of the grip portion 13. More specifically, when the cartridge B is not attached to the cartridge A, the grip portion 13 is locked at the first position and the rotation is not allowed.

In a state where the cartridge B is attached to the cartridge A, the user can rotate the grip portion 13 from the first position to the second position. The user can move the grip portion to the second position, and thereby the cartridge A can be attached to the apparatus body. In such a state, it is not possible to remove the cartridge B from the cartridge A.

Figure 7A:
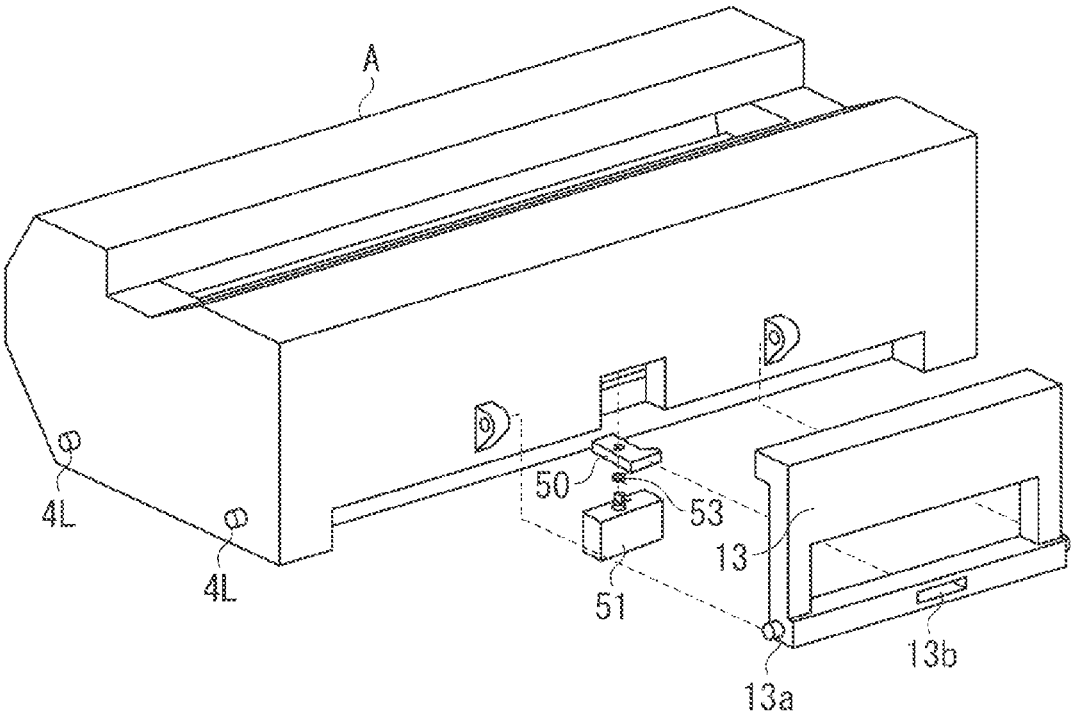
FIG. 7A is an exploded perspective view illustrating an attachment portion of a stopper and a grip portion.

FIG. 7A is an exploded perspective view illustrating the cartridge A to which the stopper 50 is attached. The stopper 50 is provided at the same height as the rotation center 13*a* of the grip portion 13 at the center in the cartridge B insertion direction. The stopper 50 is supported by a rotation shaft 51*a* provided to a supporting member 51 at the center and the stopper 50 can rotate.

Figure 7B:
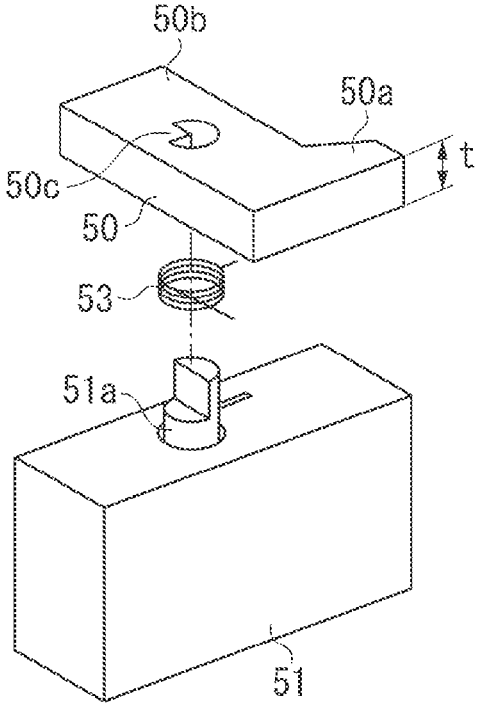
FIG. 7B is an exploded perspective view illustrating only the stopper, a supporting member, and an elastic member in FIG. 7A.
Figure 7C:
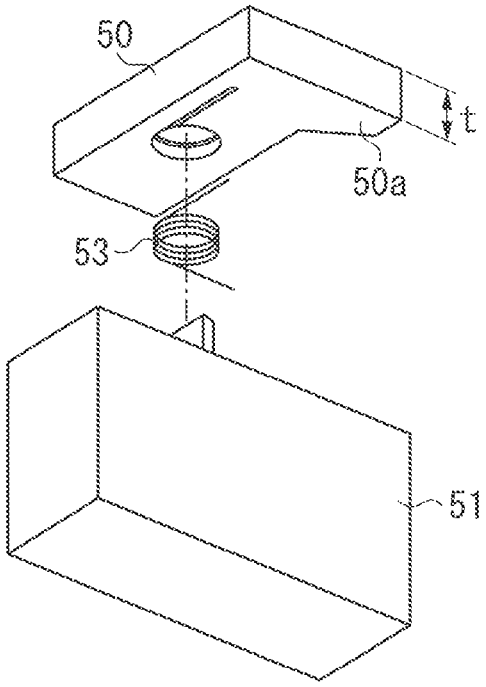
FIG. 7C is an exploded perspective view illustrating the attachment portion viewed from a direction different from that in FIG. 7B.

FIG. 7B is a perspective view illustrating the stopper 50, the supporting member 51, and an elastic member 53 in FIG. 7A. FIG. 7C is a perspective view of the components in FIG. 7B viewed from a different direction. At one end of the stopper 50, a wide regulation portion 50*a* is provided.

The other end of the stopper 50 is referred to as a pressed portion 50*b*. The position where the regulation portion 50*a* illustrated in FIG. 7 faces to the front is referred to as a first position (regulation position) (refer to FIG. 8A). The position where the regulation portion 50*a* is turned 90 degrees from the first position and faces to the right is referred to as a second position (allowable position) (refer to FIG. 8B).

A rotation stopping portion 50*c* provided to the stopper 50 regulates the stopper 50 so that the stopper 50 can rotate between the first position and the second position. The elastic member (torsion coil spring) 53 attached to the stopper 50 and the supporting member 51 urges the stopper 50 in the direction of the first position.

The grip portion 13 includes a slot (regulated portion) 13*b* corresponding to the stopper 50. The slot 13*b* is a hole provided on the shaft line of the rotation center 13*a* of the grip portion 13. The hole is provided through the grip portion 13. The direction in which the slot 13*b* opens is the front-back direction in a state where the grip portion 13 is set to the first position.

When the grip portion 13 is set to the second position, the slot 13*b* opens in the vertical direction. The height h (see FIG. 9A) of the slot 13*b* is substantially the same as the thickness t (see FIG. 7A) of the stopper 50 or the thickness t of the stopper 50 is slightly reduced as compared to the height h of the slot 13*b*. When the grip portion 13 is set at the first position, the stopper 50 can rotate and enter the slot 13*b*.

The cartridge B includes a pressing portion (projection portion) 78 corresponding to the stopper 50 (see FIGS. 6A and 6B). In the present exemplary embodiment, the pressing portion 78 is provided to a central part of the guided portion 76 of the cartridge B, and the pressing portion 78 has a convex shape protruding from the cartridge B. If the user attaches the guided portion 76 along the guide portion 55 of the cartridge A, the pressing portion 78 contacts the pressed portion 50*b* of the stopper 50 set to the first position, and the stopper 50 rotates.

<Operation of Stopper Mechanism>

Figure 8A:
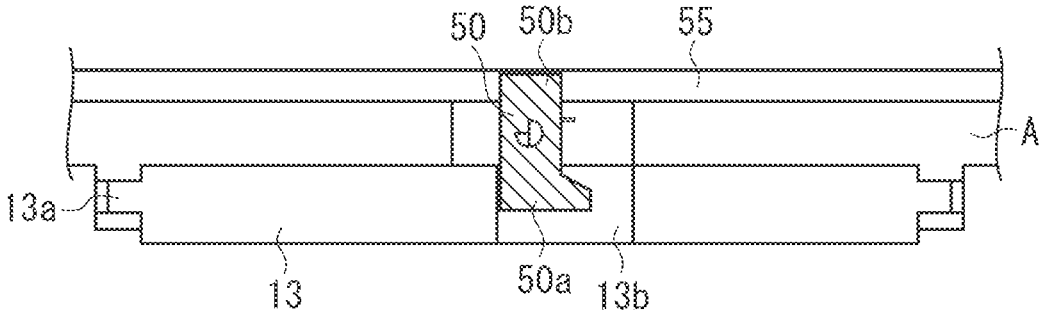
FIG. 8A is an enlarged view of a part near the stopper and the grip portion in the cross-sectional view illustrating the cartridge A and the cartridge B taken along the line c-c, and the cartridge B is not attached.
Figure 8B:
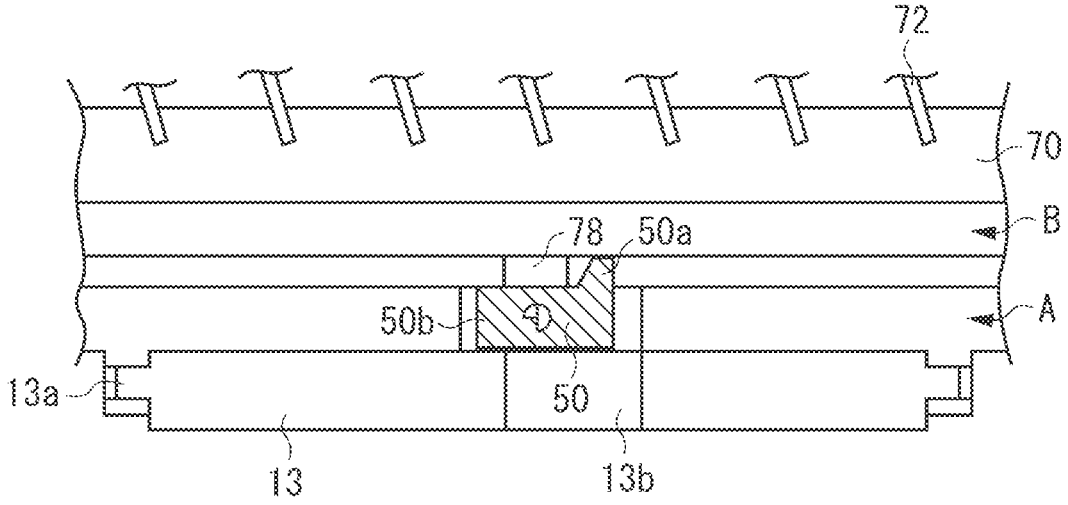
FIG. 8B is an enlarged view of the part near the stopper and the grip portion in the cross-sectional view illustrating the cartridge A and the cartridge B taken along the line c-c, and the cartridge B is attached and the grip portion is set to a first position.
Figure 8C:
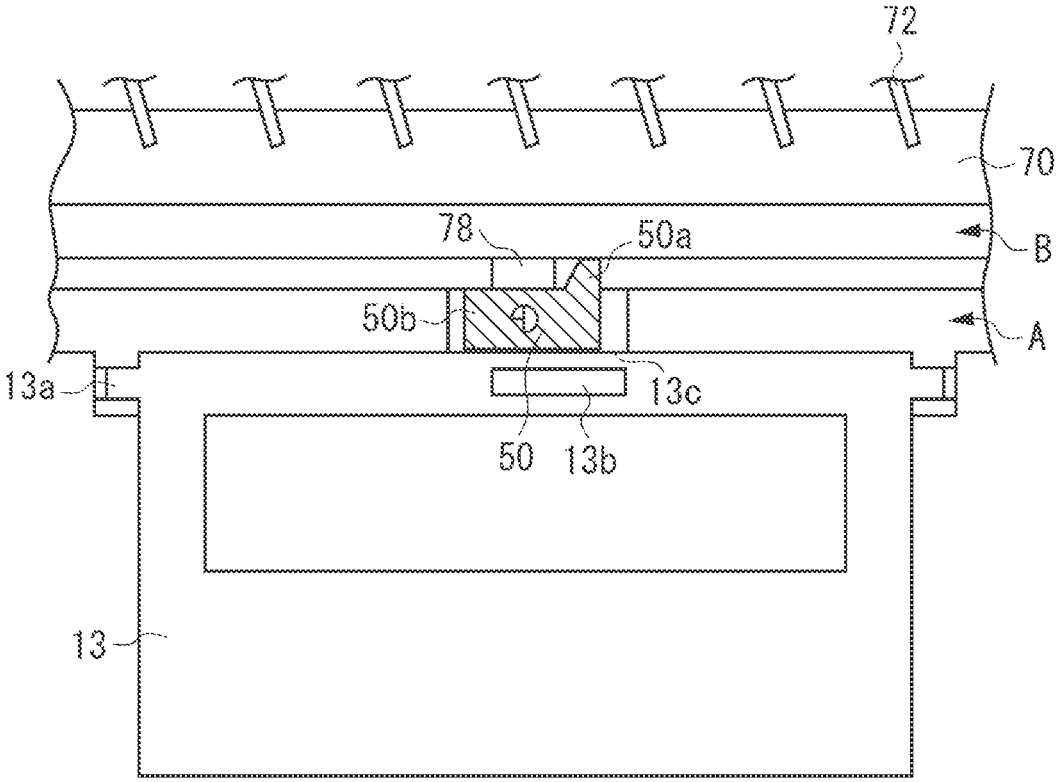
FIG. 8C is an enlarged view of the part near the stopper and the grip portion in the cross-sectional view illustrating the cartridge A and the cartridge B taken along the line c-c, and the cartridge B is attached and the grip portion is set to a second position.

Hereinafter, operations of the grip portion 13, the cartridge B, and the stopper 50 that regulates the portion 13 and the cartridge B are described. FIGS. 8A to 8C are enlarged views of a part near the stopper 50 in the cross-sectional view of the cartridge A and the cartridge B taken along the line c-c (FIG. 5A) viewed from the top.

Figure 9A:
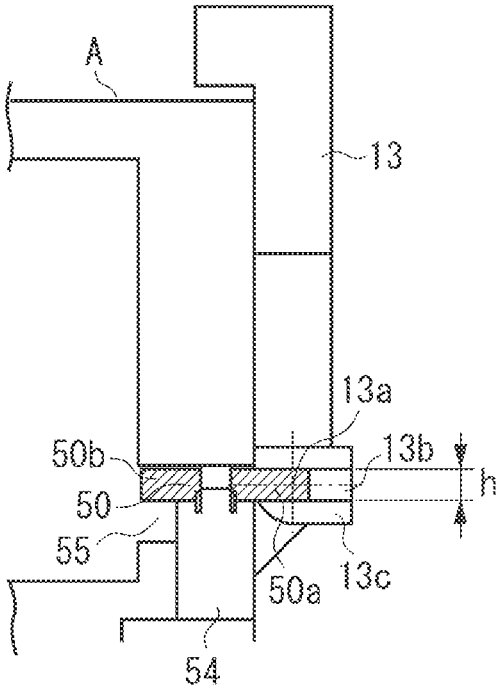
FIG. 9A is an enlarged view of a part near the stopper and the grip portion in the cross-sectional view illustrating the cartridge A and the cartridge B taken along the line d-d, and the cartridge B is not attached.
Figure 9B:
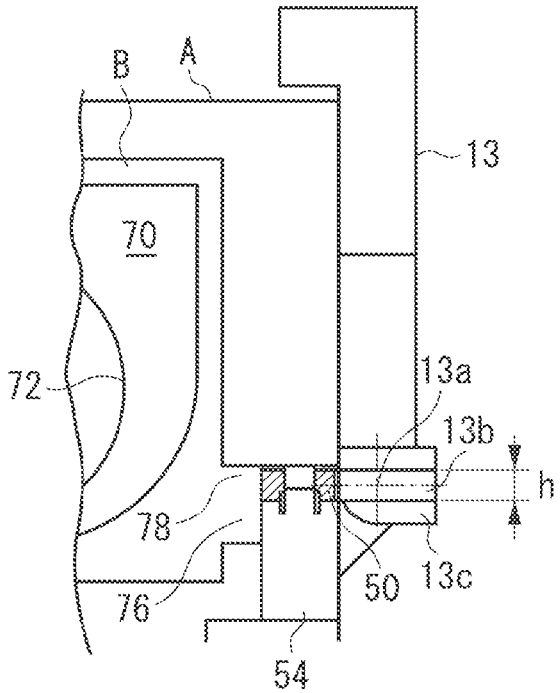
FIG. 9B is an enlarged view of the part near the stopper and the grip portion in the cross-sectional view illustrating the cartridge A and the cartridge B taken along the line d-d, and the cartridge B is attached and the grip portion is set to the first position.
Figure 9C:
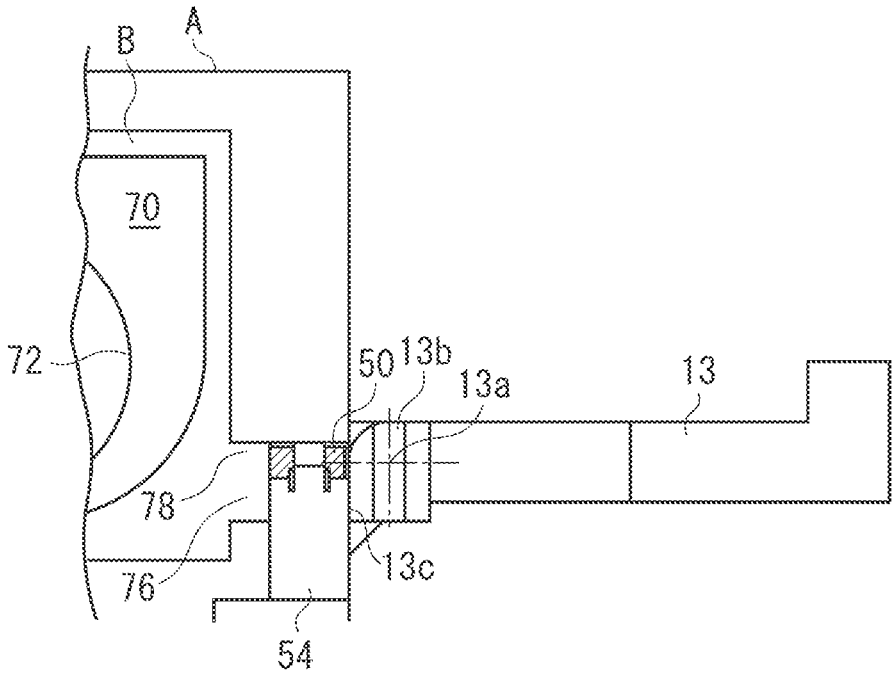
FIG. 9C is an enlarged view of the part near the stopper and the grip portion in the cross-sectional view illustrating the cartridge A and the cartridge B taken along the line d-d, and the cartridge B is attached and the grip portion is set to the second position.

FIGS. 9A to 9C are enlarged views of a part near the stopper 50 in the cross-sectional view of the cartridge A and the cartridge B taken along the line d-d (see FIG. 4) viewed from the side.

FIG. 8A and FIG. 9A illustrate a state where the cartridge B is not attached to the cartridge A. The grip portion 13 is set to the first position and the stopper 50 is set to the first position. The regulation portion 50*a* of the stopper 50 enters the slot 13*b* of the grip portion 13 and the pressed portion 50*b* protrudes onto the guide portion 55.

The slot 13*b* is provided on the shaft line of the rotation center 13*a*, and the height h is the same as the thickness t of the stopper 50. Consequently, the grip portion 13 cannot rotate around the rotation center 13*a*. As a result, when the stopper 50 is at the first position, the grip portion 13 is locked at the first position and the grip portion 13 cannot move.

FIG. 8B and FIG. 9B illustrate a state where the cartridge B is attached to the cartridge A. The grip portion 13 is set to the first position, and the stopper 50 is moved to the second position. When the user attaches the guided portion 76 of the cartridge B along the guide portion 55 of the cartridge A, the pressing portion 78 contacts the pressed portion 50*b* that protrudes onto the guide portion 55.

If the user further pushes the cartridge B, the pressing portion 78 presses the pressed portion 50*b*, and the stopper 50 rotates. Then, the stopper 50 is moved from the first position to the second position. The pressing portion 78 is provided to a position at which the contact state of the portion 78 and the pressed portion 50*b* continues when the cartridge B is completely attached to the cartridge A. As a result, the stopper 50 cannot move from the second position.

FIG. 8C illustrates a state where the cartridge B is attached to the cartridge A and the grip portion 13 is moved to the second position. As illustrated in FIG. 8B, in the state the cartridge B is attached, the stopper 50 is held at the second position and does not enter the slot 13*b*.

As a result, when the stopper 50 is at the second position, the grip portion 13 is allowed to move from the first position to the second position, and the grip portion 13 can rotate. The movement of the grip portion 13 to the second position gives a good condition for the user to attach the cartridge A to the apparatus body 101.

In such a state, to prevent the cartridge B from being removed from the cartridge A, in the present exemplary embodiment, when the grip portion 13 is set at the second position, the stopper 50 regulates the cartridge B not to be removed. As illustrated in FIGS. 8C and 9C, when the grip portion 13 is at the second position, the slot 13*b* opens in the vertical direction, and a bottom face (stopping portion) 13*c* of the grip portion 13 contacts the frame front face of the cartridge A. Consequently, if the stopper 50 tries to move to the first position, the stopper 50 interferes with the bottom face 13*c* of the grip portion 13 and cannot move.

Since the stopper 50 cannot move from the second position, if the user tries to remove the cartridge B, the pressing portion 78 interferes with the regulation portion 50*a* protruding onto the guide portion 55, and consequently, the user cannot remove the cartridge B. As a result, when the grip portion 13 is at the second position, the removal of the cartridge B can be prevented.

To remove the cartridge B from the cartridge A, the above-described operation is to be performed in reverse. First, the user moves the grip portion 13 from the second position to the first position (see FIG. 8B). Then, the user holds the holder 77 of the cartridge B with fingers, and slides the cartridge B in the right direction to remove the cartridge B. In response to the removal, the pressure by the pressing portion 78 to the pressed portion 50*b* is released.

Substantially simultaneously with the operation, the pressing portion 78 contacts the regulation portion 50*a*, and rotates the stopper 50 in the first direction. Then, the regulation portion 50*a* of the stopper 50 enters the slot 13*b*, and the stopper 50 moves to the first position (see FIG. 8A).

<Notification of Cartridge B not Being Attached>

To prevent the attachment of only the cartridge A to the apparatus body without the cartridge B being attached, the grip portion 13 notifies the user of the information, and physically regulates the attachment of only the cartridge A to the apparatus body.

In a case the cartridge B is not attached to the cartridge A, as described above, the grip portion 13 is at the first position and the stopper 50 regulates the rotation so that the grip portion 13 cannot rotate. The user who tries to attach the cartridge A to the apparatus body 101 tries to move the grip portion 13 to the second position suitable for holding the grip portion 13, however, in the state where the cartridge B is not attached, the grip portion 13 cannot be moved from the first position.

The grip portion 13 at the first position not suitable for the attachment to the apparatus body 101 enables the user to visually recognize that the preparation for the attachment of the cartridge A is not ready.

When the user tries to attach the cartridge A to the apparatus body 101 even if the grip portion 13 is at the first position not suitable for the grip, the grip portion 13 interferes (contact) with the frame of the apparatus body 101, and thereby the attachment to the apparatus body 101 can be prevented.

Figure 10:
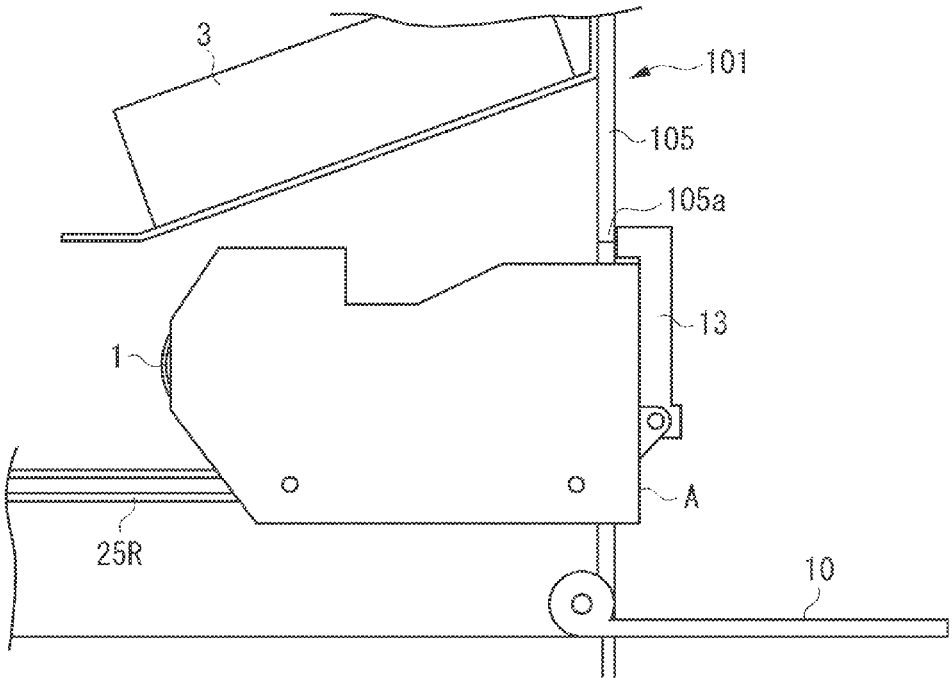
FIG. 10 is a side view illustrating a part near an opening of the apparatus body in attaching the cartridge A to the apparatus body in a state the cartridge is not attached.

FIG. 10 is a side view illustrating a state where the cartridge B is not attached to the cartridge A and the cartridge A is attached to the apparatus body 101 in a state where the grip portion 13 is at the first position. When the grip portion 13 is at the first position, if the user fits the guided portions 4L and 4R of the cartridge A to the guide portions 25L and 25R of the apparatus body to attach, the grip portion 13 contacts a stop portion 105*a* provided to the front cover 105 of the front of the apparatus body 101.

The interference of the grip portion 13 with the apparatus body 101 prevents the cartridge A from further proceeding to the inside of the apparatus body 101. In other words, when the grip portion is at the first position, the user cannot insert the cartridge A into the apparatus body 101, and the attachment of the cartridge A to the apparatus body can be prevented. As a result, the user can be notified that the cartridge A to which the cartridge B is not attached to be attached to the apparatus body 101.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-277689 filed Dec. 19, 2011, which is hereby incorporated by reference herein in its entirety.

What is claimed is:

1. A process cartridge used in an image forming apparatus, the process cartridge comprising:

a main cartridge having a process device acting on a photosensitive member and configured to be attachable and detachable to and from an apparatus body of the image forming apparatus; and a sub cartridge having a developer containing portion storing developer to be supplied to the main cartridge and configured to be attachable and detachable to and from the main cartridge, wherein the main cartridge includes:

a moving member configured to be capable of moving between a first position for preventing, by the moving member contacting the apparatus body, the main cartridge from entering the inside of the apparatus body and a second position for allowing the main cartridge to enter the inside of the apparatus body, wherein the moving member is a grip portion to be held in the attachment and detachment of the main cartridge to and from the apparatus body; and a regulation member capable of moving between a regulation position for locking the moving member at the first position and an allowable position for allowing the moving member to move from the first position to the second position, and wherein the regulation member moves from the regulation position to the allowable position by attaching the sub cartridge to the main cartridge.

2. The process cartridge according to claim 1, wherein the regulation member includes a regulation portion configured to contact the sub cartridge, in a case where the moving member is at the second position, and to regulate the removal of the sub cartridge from the main cartridge.

3. The process cartridge according to claim 1, wherein, in a case where the moving member is at the second position, a stopping portion provided to the moving member regulates the movement of the regulation member from the allowable position to the regulation position.

4. The process cartridge according to claim 1, wherein the tip of the grip portion is far from the outer surface of the main cartridge in a state where the grip portion is at the second position as compared to the position where the grip portion is at the first position.

5. The process cartridge according to claim 1, wherein the sub cartridge includes a pressing portion capable of contacting the regulation member, and the pressing portion presses the regulation member in the process of attaching the sub cartridge to the main cartridge and thereby the regulation member is moved from the regulation position to the allowable position.

6. The process cartridge according to claim 1, wherein the process device is a cleaning device configured to remove developer adhered to the photosensitive member, a charging device configured to charge the photosensitive member, or a development device configured to develop a latent image formed on the photosensitive member.

7. The process cartridge according to claim 1, wherein the main cartridge includes the photosensitive member.

8. A main cartridge attachable and detachable to and from an apparatus body of an image forming apparatus, the main cartridge comprising:

a process device configured to act on a photosensitive member;

an attachment and detachment portion capable of attaching and detaching a sub cartridge containing developer;

a moving member configured to be capable of moving between a first position for preventing, by the moving member contacting the apparatus body, the main cartridge from entering the inside of the apparatus body and a second position for allowing the main cartridge to enter the inside of the apparatus body, wherein the moving member is a grip portion to be held in the attachment and detachment of the main cartridge to and from the apparatus body; and a regulation member capable of moving between a regulation position for locking the moving member at the first position and an allowable position for allowing the moving member to move from the first position to the second position, and wherein the regulation member moves from the regulation position to the allowable position by attaching the sub cartridge to the attachment and detachment portion.

9. The main cartridge according to claim 8, wherein the regulation member includes a regulation portion configured to contact the sub cartridge, in a case where the moving member is at the second position, and to regulate the removal of the sub cartridge from the attachment and detachment portion.

10. The main cartridge according to claim 8, wherein, in a case where the moving member is at the second position, a stopping portion provided to the moving member regulates the movement of the regulation member from the allowable position to the regulation position.

11. The main cartridge according to claim 8, wherein the tip of the grip portion is far from the outer surface of the main cartridge in a state where the grip portion is at the second position as compared to the position the grip portion is at the first position.

12. The main cartridge according to claim 8, wherein the regulation member includes a pressed portion capable of contacting the sub cartridge, and the pressed portion is pressed by the sub cartridge in the process of attaching the sub cartridge to the attachment and detachment portion and thereby the regulation member is moved from the regulation position to the allowable position.

13. The main cartridge according to claim 8, wherein the process device is a cleaning device configured to remove the developer adhered to the photosensitive member, a charging device configured to charge the photosensitive member, or a development device configured to develop a latent image formed on the photosensitive member.

14. The main cartridge according to claim 8, wherein the main cartridge includes the photosensitive member.

15. A sub cartridge attachable and detachable to and from a main cartridge attachable and detachable to and from an apparatus body of an image forming apparatus, the sub cartridge comprising:

a developer containing portion configured to store developer to be supplied to the main cartridge; and a pressing portion capable of contacting a regulation member provided to the main cartridge, wherein the main cartridge includes a moving member configured to be capable of moving between a first position for preventing, by the moving member contacting the apparatus body, the main cartridge from entering the inside of the apparatus body and a second position for allowing the main cartridge to enter the inside of the apparatus body, wherein the moving member is a grip portion to be held in the attachment and detachment of the main cartridge to and from the apparatus body, wherein the regulation member is capable of moving between a regulation position for locking the moving member at the first position and an allowable position for allowing the moving member to move from the first position to the second position, and wherein the pressing portion presses the regulation member in the process of attaching the sub cartridge to the main cartridge and thereby the regulation member is moved from the regulation position to the allowable position.

16. An image forming apparatus configured to form an image on a recording medium, the image forming apparatus comprising:

a main cartridge having a process device configured to act on a photosensitive member;

a sub cartridge attachable and detachable to and from the main cartridge, and having a developer containing portion storing developer to be supplied to the main cartridge; and an apparatus body which the main cartridge can be attached to and detached from in a state where the sub cartridge is attached to the main cartridge, wherein the apparatus body includes a stopping portion configured to prevent the main cartridge from being attached to the apparatus body in a state where the sub cartridge is removed, and wherein the main cartridge includes a moving member configured to be capable of moving between a first position for preventing, by the moving member contacting the apparatus body, the main cartridge from entering the inside of the apparatus body and a second position for allowing the main cartridge to enter the inside of the apparatus body, wherein the moving member is a grip portion to be held in the attachment and detachment of the main cartridge to and from the apparatus body; and a regulation member capable of moving between a regulation position for locking the moving member at the first position and an allowable position for allowing the moving member to move from the first position to the second position, and wherein when the sub cartridge is attached to the main cartridge the regulation member thereby moves from the regulation position to the allowable position.

17. The image forming apparatus according to claim 16, wherein the regulation member includes a regulation portion configured to contact the sub cartridge in a case where the moving member is at the second position, and to regulate the removal of the sub cartridge from the main cartridge.

18. The image forming apparatus according to claim 16, wherein, in a case where the moving member is at the second position, a stopping portion provided to the moving member regulates the movement of the regulation member from the allowable position to the regulation position.

19. The image forming apparatus according to claim 16, wherein the tip of the grip portion is far from the outer surface of the main cartridge in a state where the grip portion is at the second position as compared to the position the grip portion is at the first position.

20. The image forming apparatus according to claim 16, wherein the sub cartridge includes a pressing portion capable of contacting the regulation member, and configured to press the regulation member in the process of attaching the sub cartridge to the main cartridge and thereby the regulation member is moved from the regulation position to the allowable position.

* * * * *